US009819114B2

(12) United States Patent
McCorkle et al.

(10) Patent No.: US 9,819,114 B2
(45) Date of Patent: Nov. 14, 2017

(54) BREAK-AWAY TRACTOR-TRAILER CABLE CONNECTOR

(71) Applicant: VOLVO TRUCK CORPORATION, Göteborg (SE)

(72) Inventors: Russell John McCorkle, Kernersville, NC (US); Lucius Trahan, High Point, NC (US)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 15/110,761

(22) PCT Filed: Jan. 21, 2015

(86) PCT No.: PCT/US2015/012216
§ 371 (c)(1),
(2) Date: Jul. 11, 2016

(87) PCT Pub. No.: WO2015/112580
PCT Pub. Date: Jul. 30, 2015

(65) Prior Publication Data

US 2016/0336679 A1 Nov. 17, 2016

Related U.S. Application Data

(60) Provisional application No. 61/931,228, filed on Jan. 24, 2014.

(51) Int. Cl.
*H01R 13/44* (2006.01)
*H01R 13/52* (2006.01)
(Continued)

(52) U.S. Cl.
CPC ..... *H01R 13/5202* (2013.01); *H01R 13/424* (2013.01); *H01R 13/506* (2013.01);
(Continued)

(58) Field of Classification Search
CPC ..... H01R 13/447; H01R 13/639
(Continued)

(56) References Cited

U.S. PATENT DOCUMENTS 4,061,407 A 12/1977 Snow
4,784,610 A 11/1988 Stuart
(Continued)

FOREIGN PATENT DOCUMENTS

EP 0444478 A1 9/1991
WO 2005124943 A1 12/2005

OTHER PUBLICATIONS

International Search Report (May 4, 2014) for corresponding International App. PCT/US2015/012216.
(Continued)

*Primary Examiner* — Phuong Dinh
(74) *Attorney, Agent, or Firm* — Martin Farrell; Michael Pruden

(57) ABSTRACT

An electrical connector for connecting a tractor-trailer electrical cable to a truck tractor or a trailer electrical system includes a housing defining an interior space and having a mounting flange extending radially therefrom at a head end, at least one locking tab at the head end, and a wall dividing the interior space into a head end space and a foot end space, the wall having a plurality of holes in an array, a plurality of terminal pins secured against movement in the holes in the wall and extending from the foot end space into the head end space and a connector body having an outer wall configured to slide into the head end space of the housing.

11 Claims, 3 Drawing Sheets

(51) Int. Cl.

| | |
|---|---|
| ***H01R 13/424*** | (2006.01) |
| ***H01R 13/506*** | (2006.01) |
| ***H01R 24/76*** | (2011.01) |
| *H01R 13/405* | (2006.01) |
| *H01R 24/86* | (2011.01) |

(52) U.S. Cl.
CPC ..... *H01R 13/5213* (2013.01); *H01R 24/76* (2013.01); *H01R 13/405* (2013.01); *H01R 13/521* (2013.01); *H01R 13/5219* (2013.01); *H01R 24/86* (2013.01); *H01R 2201/26* (2013.01)

(58) Field of Classification Search
USPC ..... 439/144, 589, 923, 474
See application file for complete search history.

(56) References Cited

U.S. PATENT DOCUMENTS

| | | | | |
|---|---|---|---|---|
| 4,792,308 | A * | 12/1988 | Johnson | H01R 13/22 439/35 |
| 5,626,479 | A | 5/1997 | Hughes | |
| 5,873,744 | A * | 2/1999 | Ramos, Jr. | H01R 13/6275 439/144 |
| 6,048,224 | A | 4/2000 | Kay | |
| 6,109,984 | A | 8/2000 | Tsou | |
| 6,450,833 | B1 | 9/2002 | Brown, Jr. et al. | |
| 6,554,626 | B2 | 4/2003 | Ramos, Jr. | |
| 6,716,063 | B1 * | 4/2004 | Bryant | H01R 13/5208 439/589 |
| 6,743,025 | B2 | 6/2004 | Howard | |
| 7,575,450 | B2 | 8/2009 | Williams et al. | |
| 2002/0151225 | A1 | 10/2002 | Ramos | |
| 2010/0227486 | A1 * | 9/2010 | Lin | H01R 13/447 439/144 |
| 2012/0319379 | A1 | 12/2012 | Kolda et al. | |
| 2013/0115791 | A1 | 5/2013 | Farahani | |

OTHER PUBLICATIONS

Written Opinion (May 4, 2014) for corresponding International App. PCT/US2015/012216.
Extended European Search Report dated Aug. 1, 2017 for corresponding European application No. 15740211.6.

* cited by examiner

BREAK-AWAY TRACTOR-TRAILER CABLE CONNECTOR

FIELD OF THE INVENTION

The invention relates to electrical connectors for tractor-trailer combination vehicles for connecting an electrical cable between the tractor and trailer, and between a lead trailer and any additional trailers. More particularly, the invention relates to an electrical connector assembly that will breakaway with minimal or no damage if the tractor drives away from a parked trailer with the electrical cable still plugged into the connector.

BACKGROUND

Tractor-trailer combinations may include a truck tractor coupled to pull one or more trailers. The trailer or trailers have various electrical systems (e.g., brake and running lights) that are powered by the tractor electrical system. An electrical cable is connected between the tractor and trailer to supply tractor electrical power to the trailer. A cable connector mounted on the tractor (or trailer) provides a socket to receive a plug of the trailer electrical cable. The cable connector is typically connected to a tractor wiring cable and is mounted on the rear of the truck tractor. The cable connector may be fixed to a bracket mounted to the back of the cab.

A tractor/trailer electrical connector device must meet the SAE J560b (Americas) or ISO 3731 (Europe) connection system standard, which specifies the physical terminal locations and electrical configurations. The standard also specifies that the connector have a cap with a mechanism to lock the trailer electrical cable to the connector to resist inadvertent trailer cable disconnects.

An example of this connection device that is in common use in the industry and available from Phillips Industries is shown in U.S. Pat. No. 6,743,025 to Howard. The sole figure shows a device having socket 10 that includes a barrel 13 supporting terminal pins 14. The barrel is received in a plug 60. The plug carries connectors 17 to connect the terminals 14 with a wiring harness. A flange 18 on the socket and a flange 22 on the plug overlap and are fastened to a wall of the tractor or trailer. A cap 19 as required by SAE J560b is shown in a closed position.

A second example is the device shown in U.S. Pat. No. 6,450,833 to Brown, Jr. et al. A trailer electrical cable plug 26 is shown inserted in the socket 122. As seen in FIG. 9, this device includes a cap 134 and a wedge shaped locking tab (not numbered) may be seen on the inner surface of the cap engaging a tab (also not numbered) on the plug 26. This interlocking tab arrangement is common in the industry.

This cap lock system is designed to keep the trailer electrical cable plug locked into the cab electrical socket, and is intended to allow the cable plug and the connector socket to disengage, or breakaway, when the vehicle pulls away from the trailer with the cable still connected. By disengaging, the cap locking tab will not resist the cable plug pulling out of the socket and the plug and socket can separate without damage to either. In practice, however, this locking mechanism does not always release the trailer connector plug and socket when the vehicle pulls away. The cable may pull the connector from its mounting if the locking mechanism does not release, and the connector, the bracket, and the cab wall may be damaged.

Another issue with the existing or known connector 'breakaway' solutions is they have a terminal connection system to connect the connector device to the tractor wiring harness. This added connection system adds voltage drop that may not be acceptable for a long trailer configuration such as a triple trailer. This voltage drop will also increase over time due to thermodynamics, material migration, or due to multiple disconnects. Once the voltage drop becomes too high, the system will not be able to provide the power needed for certain applications such as illumination of the tail lights.

SUMMARY OF THE INVENTION

The invention provides a trailer connector that meets the SAE-J560b or ISO 3731 connection requirement for a cap locking/breakaway device while providing a connection system that has a secondary breakaway device to allow a portion of the connector to breakaway without damage to the connector mounting on the cab if the cable is inadvertently left connected when the tractor pulls away from the trailer and the cap locking system fails to disengage.

The system according to the invention provides a connector assembly having two parts, a housing mountable to the tractor and a connector body releasably mounted to the housing. The housing carries the terminals. The connector body releasably receives the terminals and provides a socket to accept the trailer cable plug. Advantageously, terminal pins of the connector assembly are secured to the housing and remain with the housing if the connector body is pulled out during a breakaway event.

The proposed solution also reduces the complexity of the terminal connection system which will reduce or eliminate the possibility of increased of voltage drop in the system due to thermal dynamics, material migration, or multiple disconnection possibilities.

This is accomplished by a device that allows breaking away only the connector, leaving the terminals intact. By doing this, there is no need for additional terminal connection point and thus less voltage drop.

An electrical connector for a tractor-trailer electrical cable, includes a housing defining an interior space and having a mounting flange extending radially therefrom at a head end, at least one locking tab at the head end, and a wall dividing the interior space into a head end space and a foot end space, the wall having a plurality of holes in an array, a plurality of terminal pins secured against movement in the holes in the wall and extending from the foot end space into the head end space, and a connector body having an outer wall configured to slide into the head end space of the housing, the connector body defining an interior connector space and having a terminal support wall at a foot end of the connector body, the terminal support wall having an equal plurality of holes in the array, and having an external circumferential rib at a head end, wherein, the connector body is insertable in the head end space of the housing to a position with the terminal pins extending through the holes in the terminal support wall into the connector space and the at least one locking tab engaging the circumferential rib to secure the connector body in the housing.

BRIEF DESCRIPTION OF THE DRAWINGS

The invention will be better understood by reference to the following detailed description in conjunction with the appended drawings, in which.

DETAILED DESCRIPTION

Figure 1:
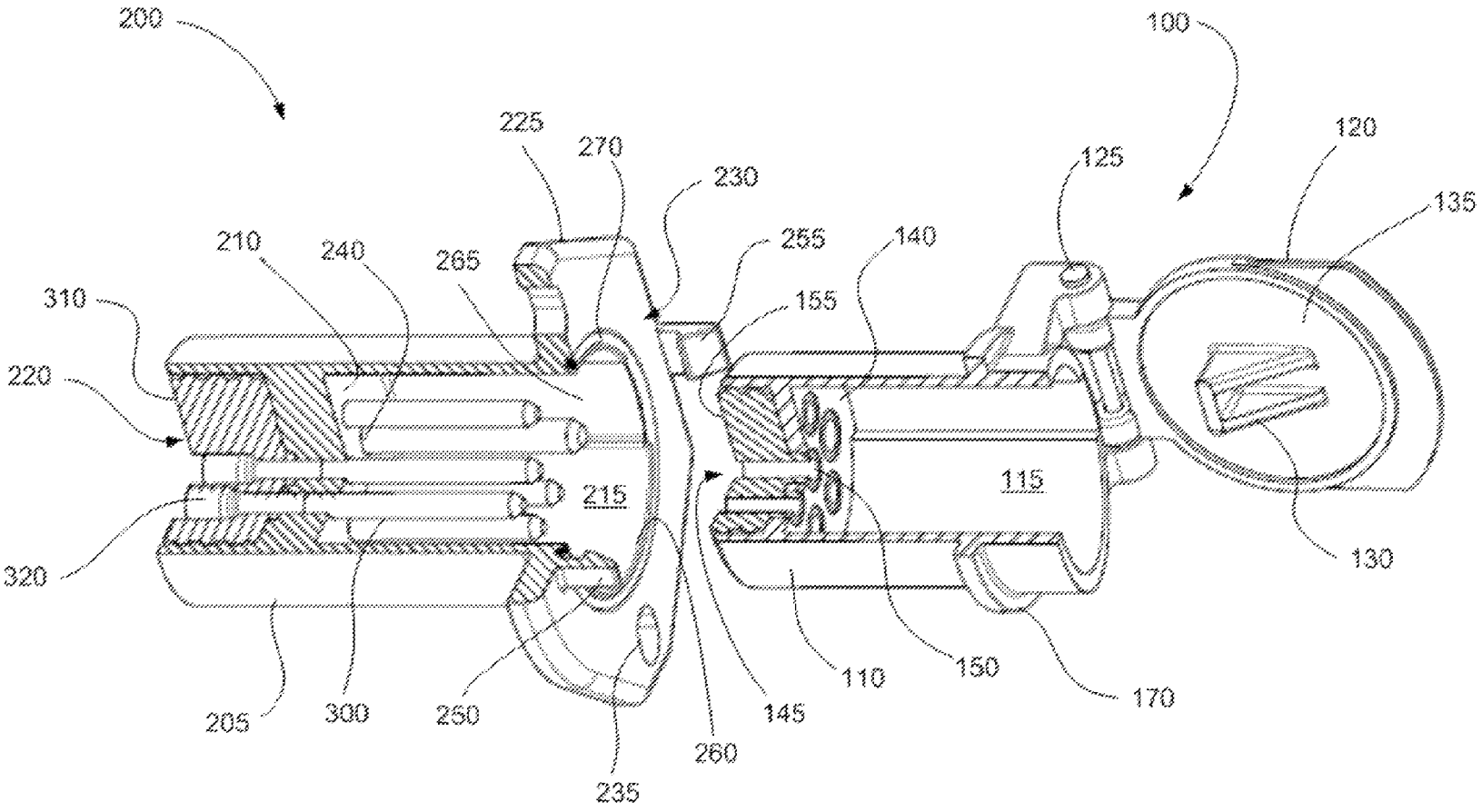
FIG. 1 is an exploded section view of a connector assembly in accordance with an embodiment of the invention.

Referring to the FIG. 1, a connector assembly according to the invention includes a SAE-J560b or ISO 3731 compliant connector body 100 and housing 200. As described below, the housing is mountable to a truck cab, for example, to a rear wall or to a mounting bracket and supports the terminal pins, which are connected to the truck cab's electrical wiring.

Figure 5:
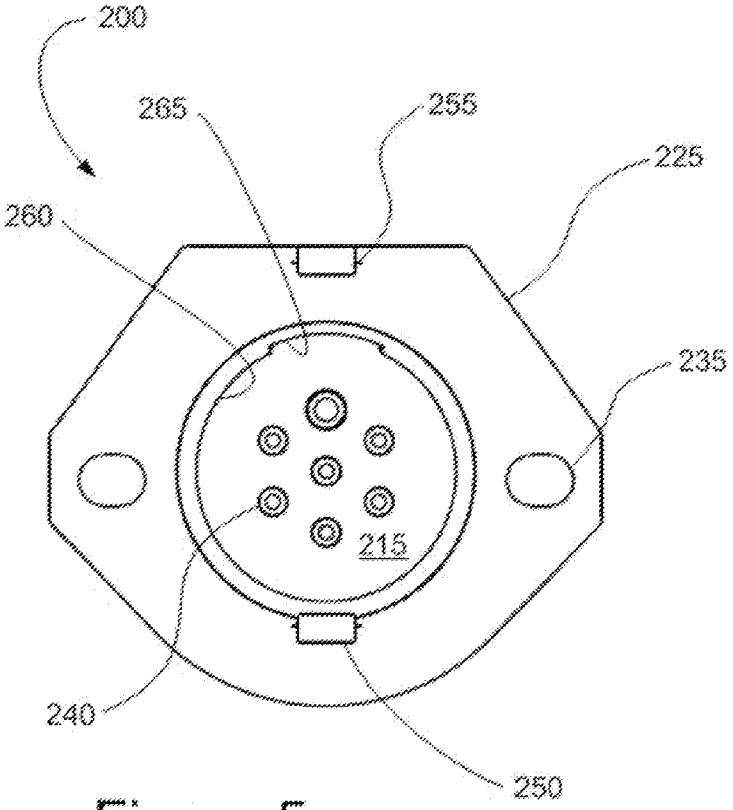
FIG. 5 is an end view of the housing member as viewed from the right end of FIG. 4.
Figure 4:
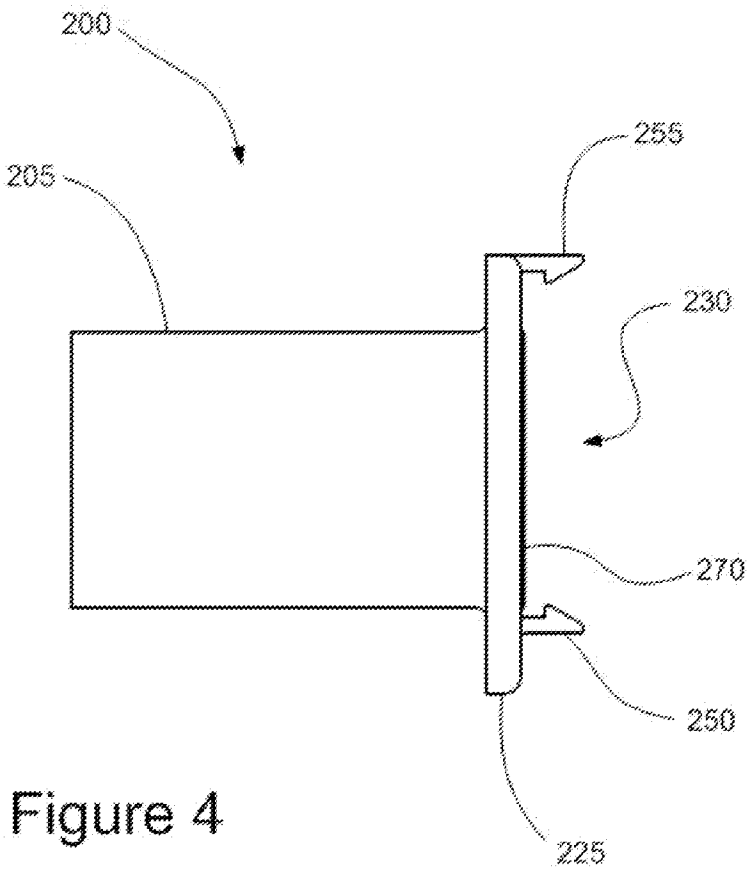
FIG. 4 is a side view of the housing member of FIG. 1.

As seen in FIGS. 1, 4, and 5, the housing 200 includes a generally cylindrical housing wall 205 and inside the housing a radially extending terminal lock wall 210 that together define a head end interior space 215 and a foot end interior space 220. A mounting flange 225 extends radially from a head end 230 by which the housing 200 may be mounted to structure on the cab. Mounting holes 235 are formed in the flange 225 for fasteners.

The terminal lock wall 210 is formed with an array of holes 240. Terminal pins 300 are secured in the holes 240 and extend from the foot end space 220 to the head end space 215. A membrane seal 310 is disposed in the foot end space 220 and seals the space against moisture. Alternatively, a terminal seal member may be disposed in the foot end space to provide a moisture seal.

The terminals 300 each have a wire crimp and insulation crimp 320 to secure the terminals directly to wires from the vehicle's electrical wiring system (not illustrated). This single wire to terminal connection replaces the two connections of conventional connectors and reduces the voltage drop across the connector. The wires may be crimped to a terminal using a standard crimp.

The terminals extend into the head end space 215 with a free length that will then be inserted into the connector body for connection with the SAE-J560b or ISO 3731 trailer cable connector as described below.

The housing 200 includes locking tabs 250, 255 extending axially at the flange 225 to releasably secure the connector body 100 to the housing. In the illustrated embodiment, one locking tab 250 is formed on the opening 260 to the interior space 215 on an inner edge of the flange 225. A second locking tab 255 is formed on an outer edge of the flange 225 opposite the first locking tab 230.

A keyway 265 may be formed on the interior of the housing wall 205 to receive a key 180 (seen in FIG. 2) formed on the connector body 100 to orient the connector body for proper insertion into the housing.

Figure 3:
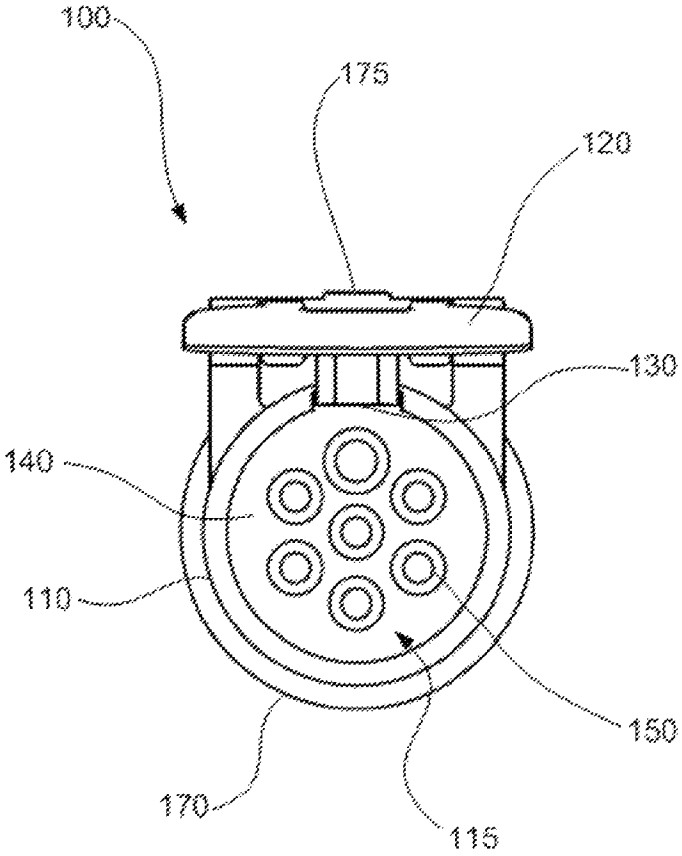
FIG. 3 is an end view of the connector body as seen looking from the right end of FIG. 2.
Figure 2:
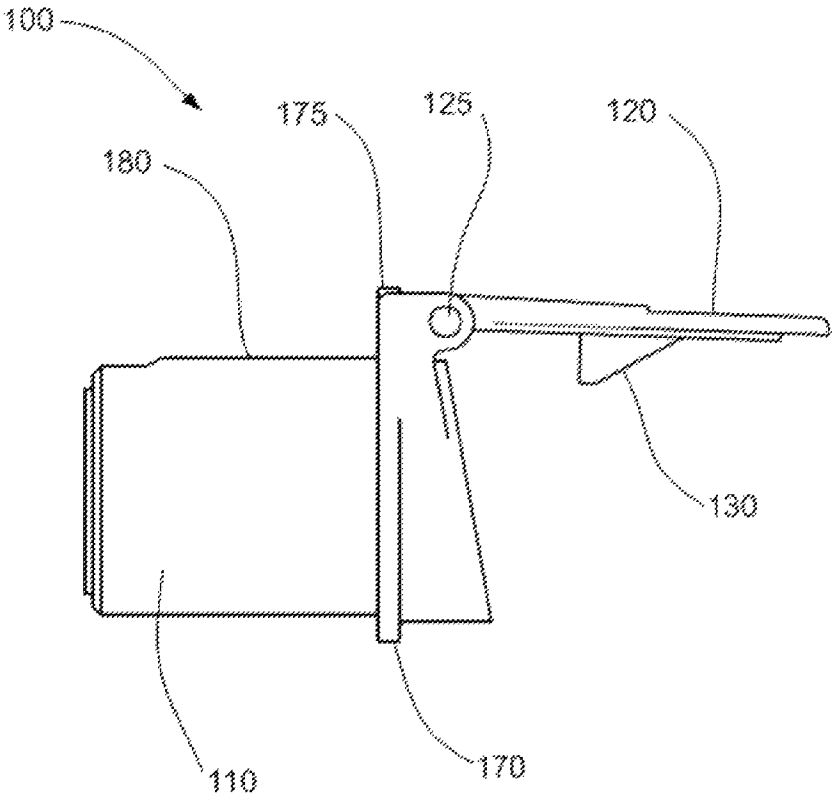
FIG. 2 is a side section view of a connector body of the assembly of FIG. 1.

Referring now to FIGS. 1, 2, and 3, the connector body 100 includes a barrel 110 that defines an interior socket space 115 to receive a plug of an electrical cable (not illustrated). A cap 120 is mounted to the connector body 100 by a spring biased hinge 125. The cap 120 is shown in an open position. A locking member 130 to engage a locking mechanism on a trailer cable is formed on an inner surface 135 of the cap 120. The inner surface 135 is the side of the cap 120 that faces the interior socket space 115 of the barrel 110 when the cap is in the closed position. The cap 120 is spring biased to the closed position.

A terminal support wall 140 radially extends in the barrel 110 and defines a closed end of the socket space 115. The terminal support wall 140 defines also a seal space 145 in the barrel 110 opposite the socket space 115. The terminal support wall 140 is formed with an equal array of holes 150 as the array of holes 240 in the housing 200 so that when the connector body 100 is inserted in the housing 200 the holes 150 in the terminal support wall 140 will align with and accept the terminals 300.

A second membrane seal 155 is disposed in the seal space 145 to prevent moisture from passing. The second membrane seal 155 includes holes to accept the terminal pins 300.

When the connector body 100 is inserted into the housing 200, the terminal pins 300 extend axially through the second membrane seal 155, through the holes 150 in the terminal support wall 140, and into the socket space 115 where the terminals may contact female terminals of a cable plug (not illustrated).

The connector body 100 includes a rib 170 formed on the outer surface of the barrel 110. The rib 170 extends circumferentially around the barrel 110, its ends merging with the hinge 125. The rib 170 provides a stop that contacts the flange 225 of the housing 200 limiting insertion movement of the connector body 100 into the housing 200. The rib 170 also contacts an o-ring seal 270 seated in a groove surrounding the opening when the connector body 100 is positioned in the housing 200.

In normal use, the connector body 100 is inserted into the interior space 210 of the housing 200. The locking tab 250 on the housing engages the rib 170 on the connector body. The locking tab 255 on the outer edge of the flange 225 engages a catch 175 formed on the hinge 125 of the connector body 100.

Alternatively, both housing locking tabs may be formed on the inner margin of the flange 225 and positioned to engage the rib 170.

The barrel 110 is shaped with a key 180 to fit in the keyway 265 in the housing 200 to orient the connector body 100 and housing.

The housing 200 is attached to the tractor (bracket or cab wall) by the flange 225 and the terminal pins 300 are secured to the housing. The connector body 100 socket space 115 accepts the trailer cable plug for connection to the terminals. The trailer cable is secured to the connector body by the lock 130 on the cap 120. The connector body 100 is secured to the housing by the locking tabs 2. If the cab drives away from a parked trailer without disconnecting the trailer connector and the cap lock 130 does not release, the tabs 250, 255 on the housing 200 will release the connector body 100, which will be pulled from the housing. Because the terminals 300 are secured to the housing 200 and not the connector body 100, pulling the connector body from the housing will not damage the terminals.

The invention has been described for attachment to a truck tractor cab, but may also be used on a trailer.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. An electrical connector for connecting a tractor-trailer electrical cable to a truck tractor or a trailer, comprising:

a connector body having an outer wall defining an interior connector space and having a terminal support wall dividing the interior space into a socket space configured to receive a plug of an electrical cable and a terminal seal space, the terminal support wall having a plurality of holes in an array, the body having an external circumferential rib at a head end;

a cap attached to the connector body by a hinge, the cap having a closed position and an open position and being spring biased toward the closed position, the cap having a lock member formed thereon;

a housing defining an interior space and having a mounting flange extending radially therefrom at a head end, at least one locking tab at the head end, and a wall dividing the interior space into a head end space and a foot end space, the wall having an equal plurality of holes in an array as in the array in the connector body;

a plurality of terminal pins secured against movement in the holes in the wall and extending from the foot end space into the head end space;

wherein, the connector body is insertable in the head end space of the housing to a position with the terminal pins extending through the holes in the terminal support wall into the connector space and the at least one locking tab engaging the circumferential rib to secure the connector body in the housing.

2. The electrical connector as claimed in claim 1, comprising a catch formed on the hinge of the connector body and a second locking tab formed on the housing to engage the catch when the connector body is inserted in the housing.

3. The electrical connector as claimed in claim 1, comprising a membrane seal disposed in the foot end space of the housing, and having an equal plurality of holes as the terminal support wall.

4. The electrical connector as claimed in claim 1, wherein the terminal pins have foot ends disposed in the foot end space of the housing and adapted for wire crimp connection to a wiring harness.

5. The electrical connector as claimed in claim 1, comprising a membrane seal disposed in the terminal seal space, the membrane seal having a plurality of holes equal to the plurality of holes in the terminal support wall.

6. An electrical connector for connecting a tractor-trailer electrical cable to a truck tractor or a trailer, comprising:

a housing defining an interior space and having a mounting flange extending radially therefrom at a head end, at least one locking tab at the head end, and a wall dividing the interior space into a head end space and a foot end space, the wall having a plurality of holes in an array;

a plurality of terminal pins secured against movement in the holes in the wall and extending from the foot end space into the head end space;

a connector body having an outer wall configured to slide into the head end space of the housing, the connector body defining an interior socket space configured to receive a plug of an electrical cable, the connector body having a terminal support wall at a foot end of the connector body, the terminal support wall having an equal plurality of holes in the array to receive the plurality of terminal pins, and having an external circumferential rib at a head end;

wherein, the connector body is insertable in the head end space of the housing to a position with the terminal pins extending through the holes in the terminal support wall into the socket space and the at least one locking tab engaging the circumferential rib to secure the connector body in the housing.

7. The electrical connector as claimed in claim 6, comprising a cap hingedly attached to the connector body at the head end, having a closed position closing the head end and having a locking wedge formed thereon.

8. The electrical connector as claimed in claim 6, comprising a catch formed on the hinge of the connector body and a second locking tab formed on the housing to engage the catch when the connector body is inserted in the housing.

9. The electrical connector as claimed in claim 6, comprising a membrane seal disposed in the foot end space of the housing, and having an equal plurality of holes as the terminal support wall.

10. The electrical connector as claimed in claim 6, wherein the terminal pins have foot ends disposed in the foot end space of the housing and adapted for wire crimp connection to a wiring harness.

11. The electrical connector as claimed in claim 6, comprising a membrane seal disposed in the terminal seal space, the membrane seal having a plurality of holes equal to the plurality of holes in the terminal support wall.

* * * * *